United States Patent [19]

Kelly

[11] 4,306,433

[45] Dec. 22, 1981

[54] KEY CASE WITH DETACHABLE KEY HOLDERS

[76] Inventor: Samuel T. Kelly, 3506 W. 224th St., Torrance, Calif. 90505

[21] Appl. No.: 119,878

[22] Filed: Feb. 8, 1980

[51] Int. Cl.[3] ..... A47G 29/10

[52] U.S. Cl. ..... 70/456 R

[58] Field of Search ..... 70/456–459; 150/40; 40/2 A, 330; 24/3 K

[56] References Cited

U.S. PATENT DOCUMENTS

| | | | |
|---|---|---|---|
| 1,719,120 | 7/1929 | Miles | 150/40 |
| 2,875,803 | 3/1959 | Greene | 150/40 |
| 3,563,293 | 2/1971 | Fisher | 150/40 |
| 4,072,033 | 2/1978 | Eckerdl | 70/456 B |

FOREIGN PATENT DOCUMENTS

| | | | |
|---|---|---|---|
| 1061552 | 11/1953 | France | 40/330 |
| 1067618 | 1/1954 | France | 40/330 |
| 1470427 | 1/1967 | France | 40/2 A |

*Primary Examiner*—Robert L. Wolfe

*Attorney, Agent, or Firm*—Victor J. Evans & Co.

[57] ABSTRACT

A key carrying device to fit comfortably in the pocket of a garment comprising a soft case, and enclosed thereby, a plurality of detachable and reattachable key holders having indicia thereon.

12 Claims, 3 Drawing Figures

KEY CASE WITH DETACHABLE KEY HOLDERS

BACKGROUND OF THE INVENTION

This invention relates generally to a novel key case and more particularly to a key carrying case including a plurality of key holders with identification, each securely retained yet easily detachable from the case.

Although a large number and variety of key carrying devices have been heretofore proposed each has had its shortcomings in utility, versatility and appeal. Two objections to key holders in general have been the awkwardness of having to hold a bulky case or ring full of keys while manipulating one attached key to operate a lock, and the inconvenience of searching for and identifying a wanted key, particularly when it is with others of similar appearance. Other desirable features commonly lacking in present art include means to secure keys to prevent objectionable jangling, means for easy separation or substitution of keys while maintaining their identity, and means to find a needed key in the dark. Whereas prior art has attempted to deal with one problem or another, none has yet effectively satisfied all the noted objections in a compact key case suitable for carrying in the pocket of a garment.

The following reflects the state of the art of which applicant is aware.

U.S. Pat. Nos. 2,875,803 Green et al;
3,011,537 Castro;
3,070,142 McGlynn;
3,415,300 Worcester;
4,037,439 Youd.

OBJECTS AND SUMMARY OF THE INVENTION

It is therefore a general object of the present invention to provide a key case having means for secure yet convenient and removable attachment of a plurality of key holders disposed snugly in a flat side-by-side relationship, and with means for identifying the keys by visual or tactile perception.

Another object of the invention is the provision of a key case of the character described which is flat and compact to fit comfortably in a garment pocket.

Yet another object of this invention is the provision of a key case of simple construction that can be economically manufactured and is durable.

Accordingly the aforesaid objects are realized in a case for carrying keys constructed of a supple material comprising two cover panels foldably connected to enclose a row of pockets for receiving keys and having fastening elements affixed thereon and a plurality of separable key holders which comprise snap hooks articulately connected to tabs, said tabs having fastening elements affixed which cooperate with the fastening elements on the case for removable attachment thereto. It is further provided that the tabs have means to identify keys by indicia cognizable by sight or touch.

In the invention's preferred embodiment, keys that are normally carried on the person are assembled on the various key holders, and a typical holder is installed in the case by inserting the shanks of such keys it retains into a case pocket and folding the tab end over that pocket to join the mating fastener elements.

Further objects and advantageous features of the invention will become apparent during the course of the following detailed description in conjunction with the accompanying drawings.

DESCRIPTION OF THE PREFERRED EMBODIMENT

Figure 1:
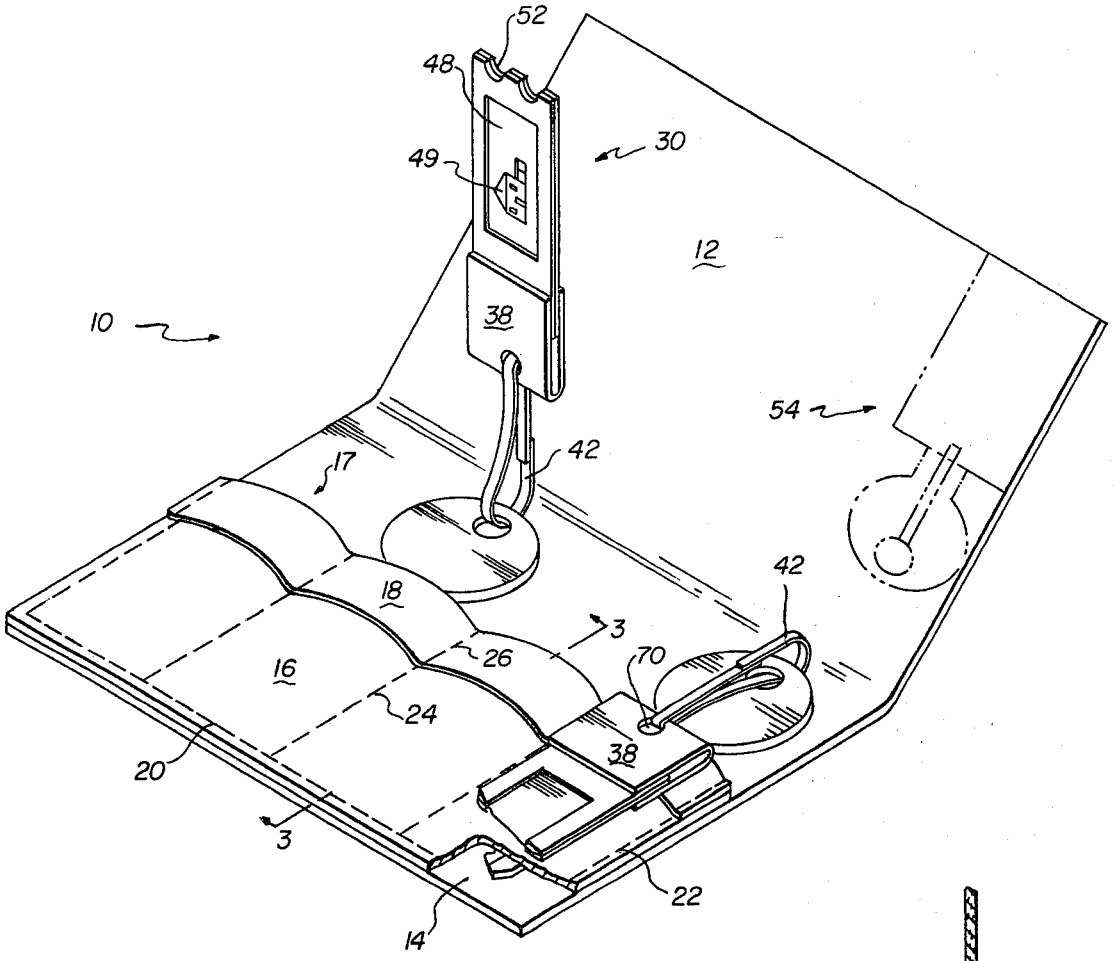
FIG. 1 is a perspective view with portions broken away of a case partly open with two of three key holders in place and one key holder partly removed embodying the present invention in one of its forms.
Figure 3:
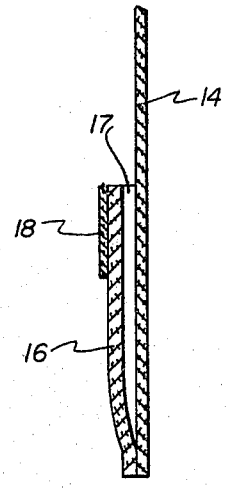
FIG. 3 is a sectional view taken along lines 3—3 of FIG. 1.

Referring now to the specific embodiment of the invention as shown in FIG. 1 by way of example only, a body portion 10 is made of a generally rectangular sheet of supple material such as leather, folded to form a pair of cover panels 12 and 14.

To the lower panel 14 a strip of similar supple material 16 is applied to form upwardly-opening pockets 17 for the reception of keys. Overlain proximate and parallel to said pocket openings is a fastener element strip 18 comprising one of a pair of mating interlocking filamentary materials as shown in U.S. Pat. Nos. 3,009,235, 3,063,718 and 3,114,951 and now sold under the trademark Velcro.

As disposed, the strip 16 is affixed to the lower panel 14 to form individual key pockets therewith by stitching along the bottom 20, sides 22, and intermediate separators 24. A continuation of said stitching 26 secures the fastener element strip 18 where it overlies said pocket forming strip 16.

A representative case is thus adapted to retain four key holders 30 of the invention in mounted position.

Figure 2:
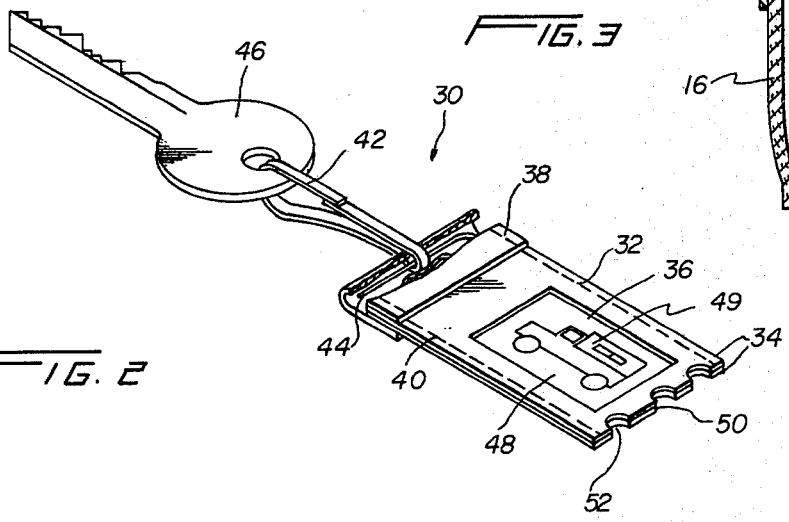
FIG. 2 is a perspective view of one key holder out of the case with portions broken away to reveal one embodiment of its construction and identification means.

A key holder 30 as represented by FIG. 2 comprises a tab body 32 of elongated rectangular form and a snap hook 42 interposed between the body 32 and key 46. The tab body 32 comprises two like strips 34 disposed back-to-back, of a flexible leatherlike material with window openings 36 and disposed folded over one end, a fastener element strip 38 of a kind to cooperate with the fastener element strip 18 of the case, for removable attachment thereto. The tab body parts are secured by stitching 40 along the sides and continuing over and across the end where the fastener element strip 38 overlaps the body 32.

An aperture 70 is provided near the middle of the fold wherein a snap hook 42 is entered to engage a hairpin type clip 44, said snap hook being a commercial device formed closed of resilient wire.

A plate 48 with identifying key function symbols 49 on both sides is inserted into the tab body 32 via a gap 50 in the tab stitching 40 to where said symbols 49 may be seen through the window openings 36. The end of a tab 32 is shown with notches 52 for additional identification of one or more key holders, which may be recognized by touch.

It should be noted that the described key holder is functionally identical, front and back, and may be mounted either side down.

In use one or more keys 46 are assembled onto each key holder 30 in the conventional manner. Each key holder 30 then is installed in the case 10 by inserting the shanks of such keys 46 it retains into a case pocket 17, then with the snap hook 42 pivoting on said keys 46, bringing the tab end down against the outside of the pocket to join the mating fastener elements 18 and 38.

The keys thus installed are doubly restrained, secure and quiet even when jarred, nevertheless each key holder may be removed in a single motion by grasping the lower end of the tab, lifting to peel away the fastening elements and continuing the motion upward to pull the key or keys out of the pocket.

Because the key holders are secure as installed, and for most convenient use, simple fold closure, as with a conventional billfold, is preferred, but it is to be understood that a case clasp means might be included.

For simplicity of illustration four key receptacles are shown mounted on only one cover panel, but it should be recognized that receptacles for four additional key holders may be affixed to the other cover panel as indicated by the key holder 54 shown in phantom.

The invention is shown in its most basic construction for clarity but it is not intended to preclude its being part of a case with other appurtenances such as a coin purse, card holder or the like.

It is obvious without further description, as amply shown in prior art, that identification means might consist of labels or the like imprinted with words or abbreviation as well as symbols. it is also well known that transparent plastic sheaths would serve as well for windows as would cut-outs.

A commercial version of the key case of the invention, for optimum comfort and capacity, will match in size other commercial key cases, being of the order of three inches wide by four inches long when closed, and containing either four or eight key holders. Its thickness may vary from seven-sixteenths inches to seven-eights inches depending on key capacity and construction materials.

It is thus provided that a singular key carrying means be available which will allow the user to: (1) operate locks with greater facility because the key being used is connected only to an easily handled tab, and perhaps one or two other keys which would lay flat in the palm of the hand. (2) Separate any key or group of keys from the others quickly and effortlessly, said keys carrying with them an identification device. (3) More quickly find, identify and access a wanted key, even in total darkness. (4) Have the comfort of a soft, flat and compact key case which maintains keys in a manner to not damage garment pockets or press painfully against the body. (5) Enjoy the noted advantages in a smart looking, yet efficient and economical key case.

Although a preferred embodiment of the invention has been illustrated and described herein, it should be recognized that numerous technical variations are possible; accordingly the appended claims are intended to cover all such variations which fall within the spirit and scope of the invention. For example, the symbolic depictions may be incorporated into the tab body itself as by embossing, hot stamping, casting or any like manufacturing process.

What is claimed is:

1. A key case or the like for retaining a plurality of keys therein and adapted to fit comfortably with a garment pocket comprising, in combination, a body portion formed of a pair of cover panels foldable along a centerline such that when folded said cover panels are in mutual registry, pockets disposed on an innerface of at least one panel such that an opening for each pocket faces said centerline, each of said pockets of suitable dimension to receive a key therein, and a key holder tethered to a key provided with means for further retaining a key in said key case defined by a fastener element strip on said key holder which adheres to a complementary fastener element strip disposed on a top face of said pocket near said opening, wherein said key holder comprises a tab body having an aperture at one extremity thereof engageable with a tether formed from a key hook which engages a clip embedded with an edge of said tab body nearest said aperture, said tab body formed from two back-to-back strips each having window openings extending therethrough, and indicia means on said holder to identify different keys, wherein said key holders are functionally symmetrical along a face of either strip.

2. The device of claim 1 wherein said indicia means comprises symbolic depictions correlated to the intended key use slideably disposed between said two strips.

3. The device of claim 2 wherein said indicia means further includes tactually discernable edge irregularities remote from said apertured edge.

4. The device of claim 3 wherein said clip is a hairpin type of clip.

5. The device of claim 3 wherein said depictions are removable from said two strips along said tactually discernable edge.

6. The device of claim 3 wherein said irregularities are holes.

7. The device of claim 3 wherein said irregularities are bumps.

8. The device of claim 1 wherein said pockets are disposed on innerfaces of both panels.

9. A key case adapted to fit in a garment pocket comprising in combination, a body portion foldable along a center line to form a pair of cover panels, a series of key pockets opening towards said centerline on an innerface of at least one panel, fastener means fixed to the front of said pockets, and a plurality of key holders, each comprising a metal key loop articulately connected to a tab and fixed thereon a complimentary fastener means which adheres to said fastener means disposed on said pockets, the combined key case and key holders are thus adapted to hold keys in said pockets and with respective key holder tabs doubled over to detachably mount on said pocket fronts, to permit key separation in a simple lifting motion of said tab.

10. A key case and key holder combination according to claim 3 wherein symbolic depictions correlated to key use are included in said key holder tabs.

11. A key case and key holder combination according to claim 3 wherein a set of bumps or such tactually discernable surface irregularities are incorporated in said key holder tabs.

12. A key case and key holder combination according to claim 3 wherein said key holders are functionally identical along either tab face.

* * * * *